US011721898B2

(12) United States Patent
Sun et al.

(10) Patent No.: US 11,721,898 B2
(45) Date of Patent: Aug. 8, 2023

(54) PHASE SHIFTER AND ANTENNA

(71) Applicants: Beijing BOE Technology Development Co., Ltd., Beijing (CN); BOE Technology Group Co., Ltd., Beijing (CN)

(72) Inventors: Tuo Sun, Beijing (CN); Siyi Yin, Beijing (CN); Yonghan Wu, Beijing (CN)

(73) Assignees: Beijing BOE Technology Development Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/424,862

(22) PCT Filed: Jan. 15, 2021

(86) PCT No.: PCT/CN2021/072089

§ 371 (c)(1),
(2) Date: Jul. 21, 2021

(87) PCT Pub. No.: WO2021/143820

PCT Pub. Date: Jul. 22, 2021

(65) Prior Publication Data

US 2022/0344808 A1 Oct. 27, 2022

(30) Foreign Application Priority Data

Jan. 19, 2020 (CN) ..... 202010058496.3

(51) Int. Cl.
*H01Q 3/36* (2006.01)
*H01P 1/18* (2006.01)
(Continued)

(52) U.S. Cl.
CPC ..... *H01Q 3/34* (2013.01); *H01P 1/184* (2013.01); *H01Q 13/206* (2013.01)

(58) Field of Classification Search
CPC . H01P 1/184; H01P 1/18; H01P 1/181; H01Q 13/20; H01Q 13/206; H01Q 3/34; H01Q 3/36
See application file for complete search history.

(56) References Cited

U.S. PATENT DOCUMENTS 11,189,920 B2 * 11/2021 Liu ..... H01Q 3/36
11,336,010 B2 * 5/2022 Fang ..... H01Q 9/0457
(Continued)

FOREIGN PATENT DOCUMENTS

CN 108563050 A 9/2018
CN 208655852 U 3/2019
(Continued)

OTHER PUBLICATIONS

Takeda, Yuki, Withawat Withayachumnankul, and Yasuaki Monnai. "Study of Microstrip-Based Terahertz Phase Shifter Using Liquid Crystal." 2019 44th International Conference on Infrared, Millimeter, and Terahertz Waves (IRMMW-THz). IEEE, 2019.
(Continued)

*Primary Examiner* — Tho G Phan
(74) *Attorney, Agent, or Firm* — IPro, PLLC

(57) ABSTRACT

A phase shifter and an antenna are provided. The phase shifter includes: oppositely arranged first and second substrates; a medium layer between the first and second substrates and having an adjustable dielectric constant; a phase shift unit including a transmission line and a phase control electrode, the transmission line being between the first substrate and the medium layer, and the phase control electrode being between the second substrate and the medium layer; and multiple first wires for regulating an electric field between the transmission line and the phase control electrode, an orthographic projection of the first wires onto the first substrate being parallel to an orthographic projection of the transmission line onto the first substrate, the orthographic projection of the first wires onto the first substrate being on opposite sides of the orthographic projection of the transmission line onto the first substrate.

11 Claims, 5 Drawing Sheets

(51) Int. Cl.
*H01Q 3/34* (2006.01)
*H01Q 13/20* (2006.01)

(56) References Cited

U.S. PATENT DOCUMENTS

| | | | | |
|---|---|---|---|---|
| 11,380,990 | B2 * | 7/2022 | Jia | H01Q 1/38 |
| 11,424,520 | B2 * | 8/2022 | Hu | G02F 1/1343 |
| 11,563,260 | B2 * | 1/2023 | Wang | H01P 1/184 |
| 2020/0266511 | A1 | 8/2020 | Kong et al. | |
| 2021/0080765 | A1 | 3/2021 | Hu et al. | |
| 2021/0265713 | A1 | 8/2021 | Fang et al. | |

FOREIGN PATENT DOCUMENTS

| | | | |
|---|---|---|---|
| CN | 110137636 | A | 8/2019 |
| CN | 107394318 | B | 11/2019 |
| EP | 1128459 | A2 | 8/2001 |
| JP | 2005064632 | A | 3/2005 |

OTHER PUBLICATIONS

CN 2020100584963 first office action.
PCT/CN2021/072089 international search report and written opinion.

* cited by examiner

PHASE SHIFTER AND ANTENNA

CROSS-REFERENCE TO RELATED APPLICATIONS

The present application is a U.S. national phase application of a PCT Application No. PCT/CN2021/072089 filed on Jan. 15, 2021, which claims priority to Chinese Patent Application No. 202010058496.3 filed in China on Jan. 19, 2020, which is incorporated herein by reference in its entirety.

TECHNICAL FIELD

The present disclosure relates to the field of electromagnetic wave technology, and more particularly to a phase shifter and an antenna.

BACKGROUND

A phase shifter is a device that can adjust the phase of electromagnetic waves, and it is widely used in the fields of radar, missile attitude control, accelerator, communication, instrument and apparatus, and even music. Based on the fact that liquid crystal manifests varying dielectric constant under varying electric field intensity, the liquid crystal microstrip phase shifter changes the dielectric constant of liquid crystals between a microstrip transmission line and the ground by changing a voltage therebetween, so as to modulate the phase of an electromagnetic wave signal. However, since a thickness of a liquid crystal layer in a liquid crystal cell required by an apparatus such as a liquid crystal phase shifter is significant, e.g., mostly more than 100 μm, and a width of a microstrip transmission line is also on the order of 100 μm, an electric field between the microstrip transmission line and the ground cannot be treated like ideal infinite parallel plates. The directionality and magnitude of the electric field at both side edges of the microstrip transmission line differ greatly from those at a central position. In the case where the voltage variation is determined, the change in the dielectric constant of the liquid crystals in these regions is less than that in the ideal situation, resulting in insufficient phase difference.

SUMMARY

The present disclosure is directed to provide a phase shifter and an antenna, so as to improve a phase shifting capability of a phase shifter.

The technical solutions provided by the present disclosure are as follows.

In one aspect, an embodiment of the present disclosure provides a phase shifter, including:

a first substrate and a second substrate arranged opposite to each other;

a medium layer located between the first substrate and the second substrate, wherein a dielectric constant of the medium layer is adjustable;

a phase shift unit, wherein the phase shift unit includes a transmission line and a phase control electrode, the transmission line is arranged between the first substrate and the medium layer, and the phase control electrode is arranged between the second substrate and the medium layer; and a plurality of first wires, wherein the plurality of first wires are used for regulating an electric field between the transmission line and the phase control electrode, and an orthographic projection of the plurality of first wires onto the first substrate is parallel to an orthographic projection of the transmission line onto the first substrate, the orthographic projection of the plurality of first wires onto the first substrate is on opposite sides of the orthographic projection of the transmission line onto the first substrate, and the plurality of first wires are spaced from the transmission line by a first distance in a line width direction of the transmission line.

Optionally, the medium layer is a liquid crystal layer, a lead zirconate titanate layer, or a barium strontium titanate layer.

Optionally, each of the plurality of first wires is a high-resistance wire having a resistance value 2 to 3 times a resistance value of the transmission line.

Optionally, each of the plurality of first wires is made of an ITO or IZO material.

Optionally, each of the plurality of first wires has a resistance value ranging from 70 ohms to 80 ohms.

Optionally, each of the plurality of first wires has a line width ranging from 5 nm to 10 nm.

Optionally, one of the first wires is disposed on each of two opposite sides of the transmission line.

Optionally, at least two of the first wires are disposed on each of two opposite sides of the transmission line, and adjacent two first wires of the at least two first wires are spaced from each other by a second distance.

Optionally, three of the first wires are disposed on each of two opposite sides of the transmission line.

Optionally, the transmission line is wired in a serpentine pattern, and each of the plurality of first wires is wired in a serpentine pattern following a same direction as the transmission line.

An antenna including a phase shifter as described above is provided.

DETAILED DESCRIPTION

To further clarify the objects, features and advantages of the embodiments of the present disclosure, a more particular description of the present disclosure will be rendered by reference to specific embodiments thereof which are illustrated in the appended drawings. Obviously, the embodiments described in the present disclosure are part of the all embodiments, in which some, but not all embodiments of the disclosure are shown. Based on the embodiments in the present disclosure, all other embodiments obtained by a person of ordinary skill in the art without inventive effort are within the scope of this disclosure.

Unless defined otherwise, technical or scientific terms used in this disclosure shall have the ordinary meaning as understood by one of ordinary skill in the art to which this disclosure belongs. As used in this disclosure, the terms "first", "second" and the like do not denote any order, quantity, or importance, but rather are used to distinguish one element from another. Similarly, the use of the terms "one", "an" or "the" do not denote a limitation of quantity, but rather denote the presence of at least one instance. The word "include" or "comprise" or the like, means that the element or component preceded by the word is inclusive of the element or component listed after the word and its equivalents, and does not exclude other elements or components. Similar terms such as "connect" or "connected" are not limited to physical or mechanical connections, but may include electrical connections, whether direct or indirect. "Upper", "lower", "left", "right" and the like are used merely to denote relative positional relationships, which may change accordingly when the absolute position of the object being described changes.

Considering the case that in the related art, insufficient phase difference is caused by large magnitude difference between an electric field at the two side edges of a microstrip transmission line and an electric field at the central position in the liquid crystal phase shifter, the embodiments of the present disclosure provide a phase shifter and an antenna, so as to improve the phase shifting capability of the phase shifter.

Figure 1:
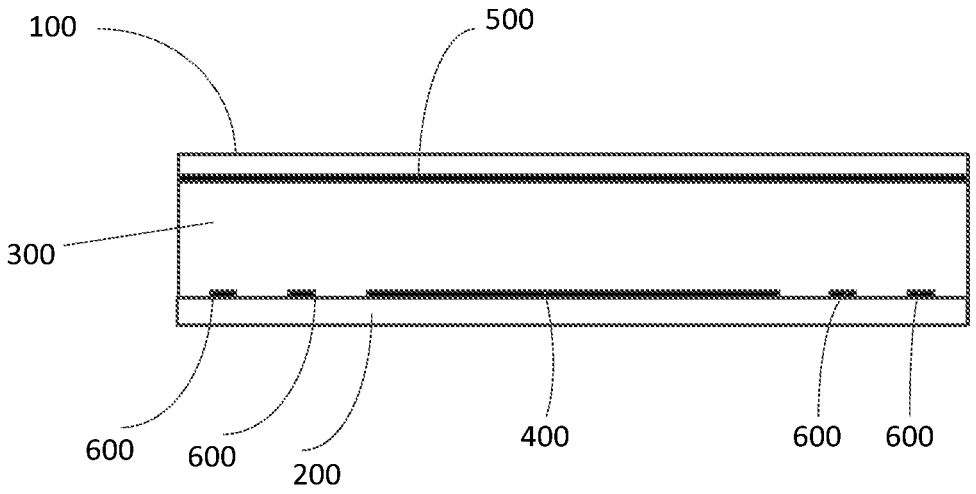
FIG. 1 is a schematic structural diagram of a phase shifter provided by an embodiment of the present disclosure.

In one aspect, as shown in FIG. 1, an embodiment of the present disclosure provides a phase shifter, including:

a first substrate 100 and a second substrate 200 arranged opposite to each other;

a medium layer 300 located between the first substrate 100 and the second substrate 200, wherein the dielectric constant of the medium layer is adjustable;

a phase shift unit, wherein the phase shift unit includes a transmission line 400 and a phase control electrode 500, the transmission line 400 is arranged between the first substrate 100 and the medium layer 300, and the phase control electrode 500 is arranged between the second substrate 200 and the medium layer 300; and a plurality of first wires 600 for regulating an electric field between the transmission line 400 and the phase control electrode 500, wherein an orthographic projection of the plurality of first wires 600 onto the first substrate 100 is parallel to an orthographic projection of the transmission line 400 onto the first substrate 100, the orthographic projection of the plurality of first wires 600 onto the first substrate 100 is located on two opposite sides of the orthographic projection of the transmission line 400 onto the first substrate 100, and the plurality of first wires are spaced from the transmission line 400 by a first distance in a line width direction of the transmission line 400.

In the above-described solution, first wires 600 are provided on two opposite sides of the transmission line 400 of the phase shifter, the first wires 600 function to add additional electrostatic terminals on both sides of the transmission line 400, so that the electric field distribution between the transmission line 400 and the phase control electrode 500 is more uniform. Thus, the electric field distribution between the transmission line 400 and the phase control electrode 500 is regulated by adding the first wire 600 on two sides of the transmission line 400 respectively, and the electric field distribution in the medium layer 300 between the transmission line 400 and the phase control electrode 500 can be closer to the ideal uniform distribution in a parallel plate capacitor. As a result, a variation range of effective dielectric constant of the medium layer 300 which effectively influences the electromagnetic wave phase is enlarged, to achieve a goal of improving the phase shifting capacity of the phase shifter.

Here, it is to be noted that the first wires 600 are such that an equipotential surface near the transmission line 400 is as parallel as possible to a surface of the first wires 600, so that the electric field between the transmission line 400 and the phase control electrode 500 is more uniform.

In addition, it should be noted that in the above-mentioned solution, the transmission line 400 may be a microstrip transmission line, but is not limited thereto; the two opposite sides of the transmission line 400 mean that a distance between the two opposite sides of the transmission line is a line width of the transmission line. The first wires 600 and the transmission line 400 may all be arranged onto the first substrate 100, and the first wires 600 and the transmission line 400 may be arranged in the same layer or may be arranged in different layers, as long as the orthographic projection of the plurality of first wires 600 onto the first substrate 100 is parallel to the orthographic projection of the transmission line 400 onto the first substrate 100 and is located on two opposite sides of the orthographic projection of the transmission line onto the first substrate.

In addition, in the phase shifter provided by the embodiment of the present disclosure, the medium layer 300 may be a liquid crystal layer, but the present disclosure is not limited thereto; any material with a dielectric constant changing in a specific frequency band under the control of an electric field or a magnetic field may be used, for example: PZT (Plumbum Zirconate Titanate), BIST (Barium Strontium Titanate), etc.

Further, in the phase shifter provided in the embodiment of the present disclosure, each of the plurality of first wires 600 is a high-resistance wire, whose resistance value is 2 to 3 times the resistance value of the transmission line 400.

With the above-mentioned solution, the first wire 600 is a high-resistance wire, and its resistance value should be greater than the resistance value of the transmission line 400 by 2 to 3 orders of magnitude. The specific resistance value of the first conductive wire 600 may be determined by a simulation factoring in parameters such as the line width and shape of the transmission line 400, dielectric constants of the first substrate 100 and the second substrate 200, a dielectric constant of a medium layer. In determining the resistance value, the thickness of the first wire 600 may also be taken account of.

In addition, the first wire 600 may be made of a high resistance material such as ITO (indium tin oxide) or IZO (indium zinc oxide).

Further, in an exemplary embodiment, the resistance value of the first wire 600 ranges from 70 to 80 ohms; the first wire 600 has a line width ranging from 5 to 10 nm.

With the above solution, since the resistance value of the first wire 600 can reach 70 to 80 ohms, which is much higher than the resistance value of thick copper commonly used for the transmission line 400, and the width of the first wire 600 ranges from 5 to 10 nm, which is very narrow, no additional insertion loss is introduced. It is, of course, understood that in practical applications, as described above, the resistance value of the first wire 600 is not limited thereto.

It should also be noted that, the first wires 600 may be applied with the same voltage as that applied to the transmission line 400, or may be separately applied with a voltage different from that applied to the transmission line 400, to obtain a better phase shifting effect.

Further, in one exemplary embodiment, one of the first wires 600 is disposed on each of two opposite sides of the transmission line 400.

Further, in one exemplary embodiment, at least two of the first wires 600 are disposed on each of two opposite sides of the transmission line 400, and adjacent two first wires of the at least two first wires 600 are spaced from each other by a second distance.

Figure 2:
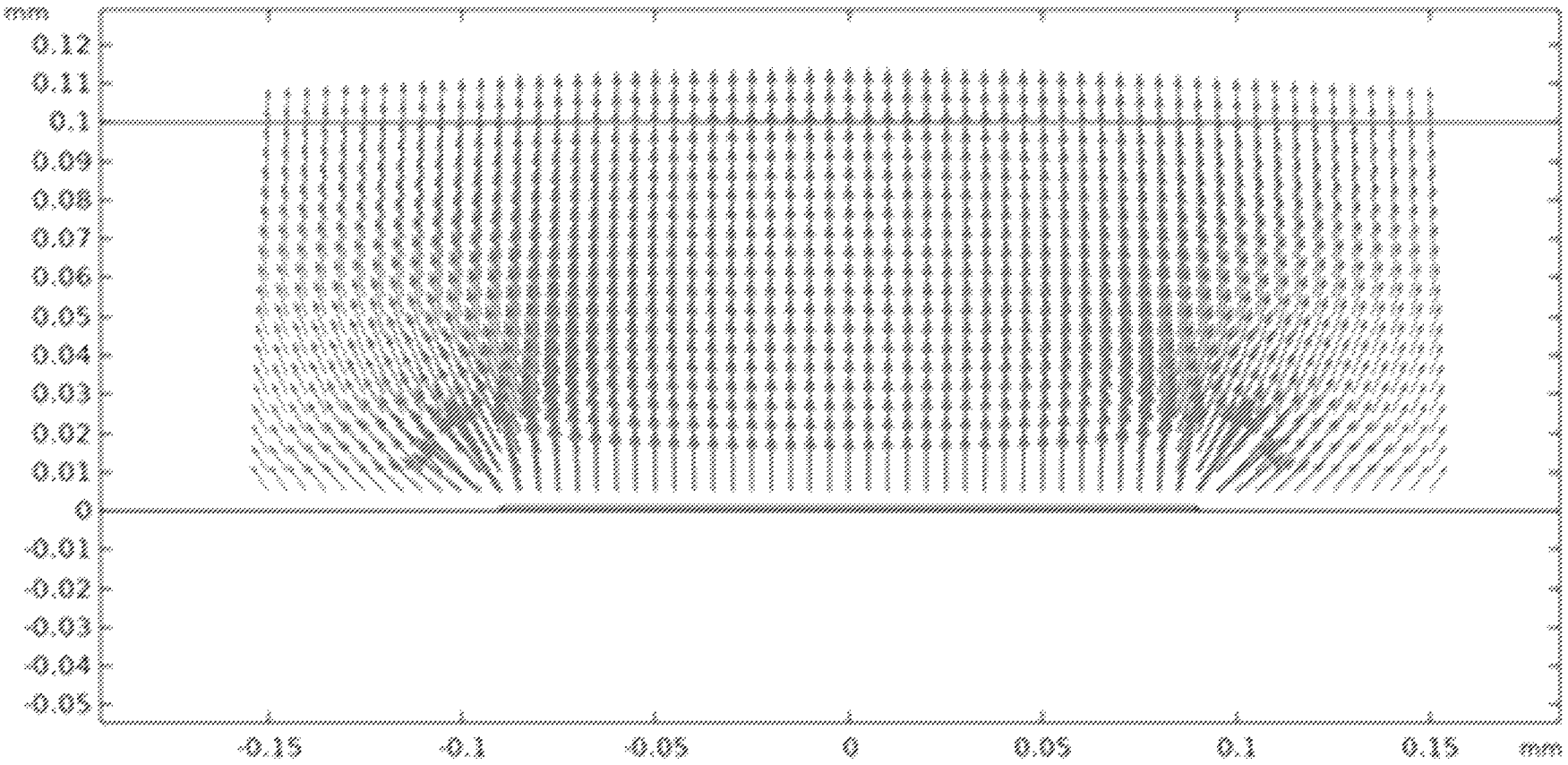
FIG. 2 is an electric field distribution diagram of a phase shifter in the related art.
Figure 3:
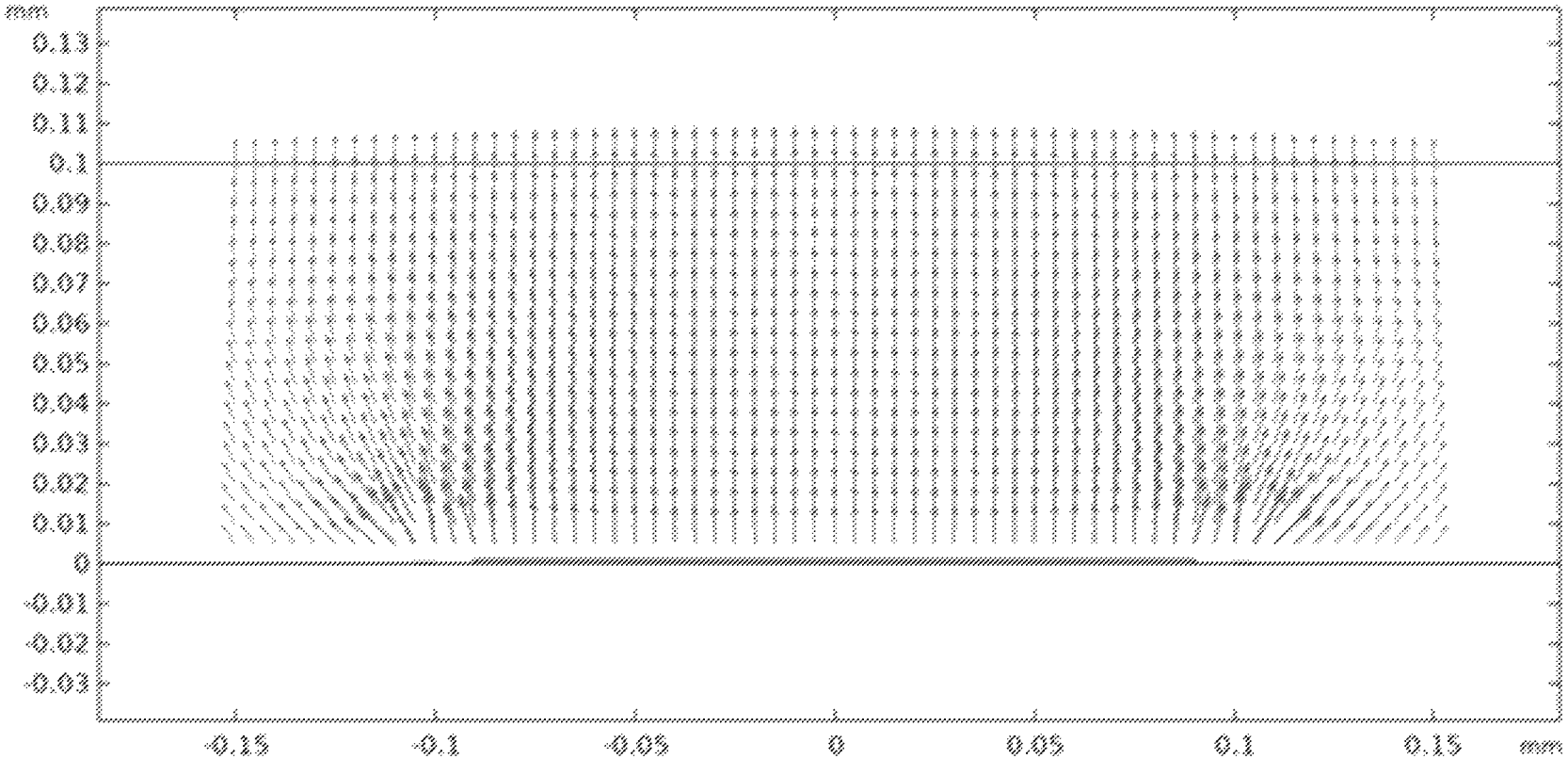
FIG. 3 is an electric field distribution diagram of a phase shifter provided in Example 1 of the present disclosure.
Figure 4:
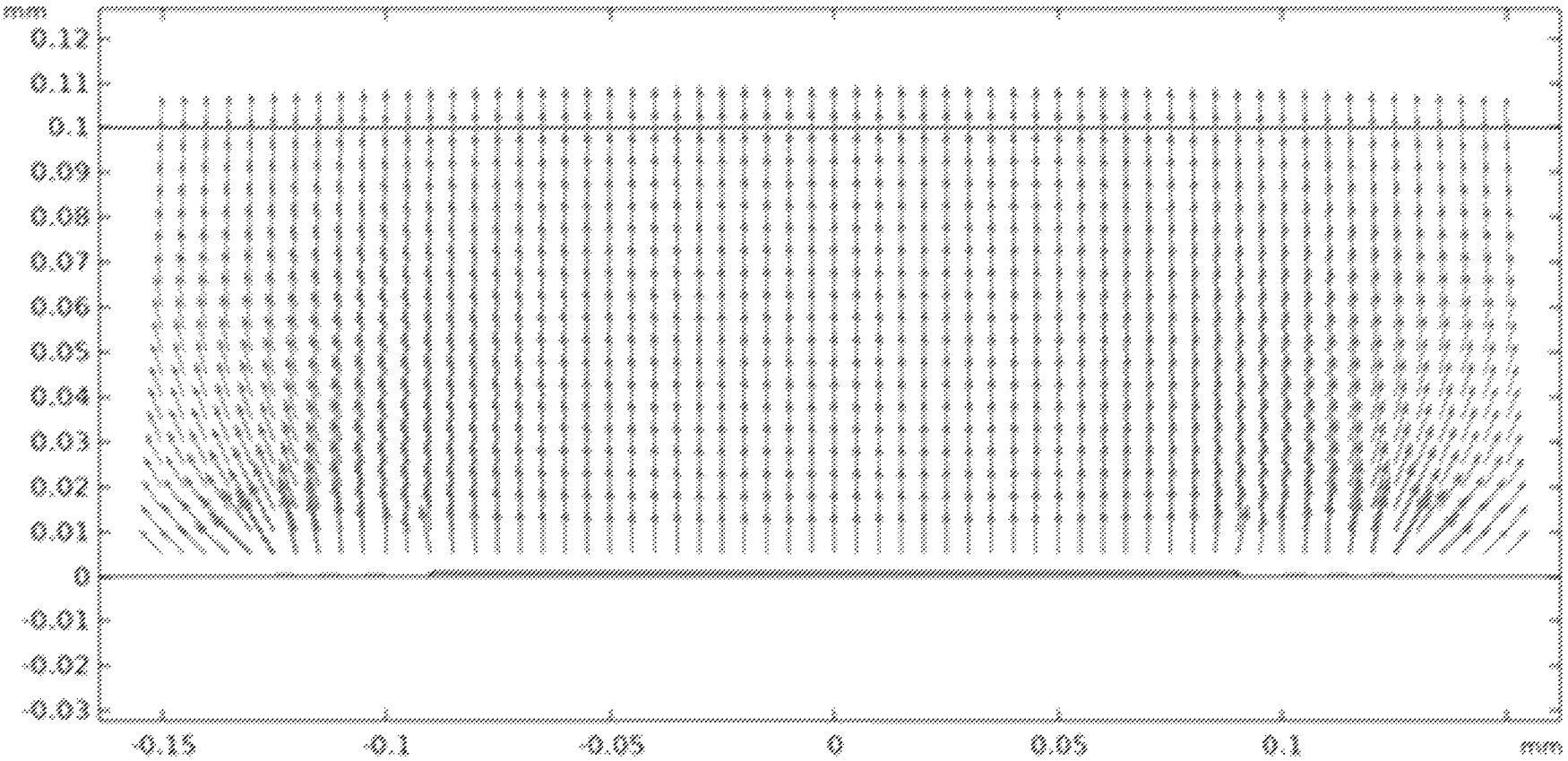
FIG. 4 is an electric field distribution diagram of a phase shifter provided in Example 2 of the present disclosure.

A simulation design is performed based on not arranging the first conductive wires 600 on two opposite sides of the transmission line 400, arranging one first wire 600 on each of two opposite sides of the transmission line 400 and arranging three first wires 600 on each of two opposite sides of the transmission line 400, respectively, to obtain electric field distribution diagrams. FIG. 2 is an electric field distribution diagram of the case in which the first wire 600 is not provided. FIG. 3 is the electric field distribution of the case in which one of the first wires 600 is arranged on each side. FIG. 4 is the electric field distribution diagram of the case in which three of the first wires 600 are arranged on each side. FIG. 6 is a diagram showing a comparison between an electric field regulation effect of a phase shifter in the related art and electric field regulation effects of phase shifters provided in Examples 1 and 2 of the present disclosure, wherein X-coordinate represents a coordinate in the horizontal direction with the midpoint of the transmission line in FIG. 1 being the origin of the coordinate, and the Y-coordinate denotes a modulus of electric field intensity; curve a illustrates an electric field intensity distribution of a phase shifter in the related art, curve b illustrates an electric field intensity distribution of a phase shifter in Example 1, and curve c illustrates an electric field intensity distribution of a phase shifter in Example 2. It can be seen from FIGS. 2 to 6 that, increasing the number of the first wires 600 has the best effect of improving the uniform distribution of the electric field. For different types of phase shifters, due to the different thicknesses of the devices, there will be different requirements in regard to the line width, spacing and number of the first wires 600, which can be determined through specific simulation. The first wires 600 with a less line width and a more dispersed distribution are better at improving the uniform distribution of the electric field.

Figure 5:
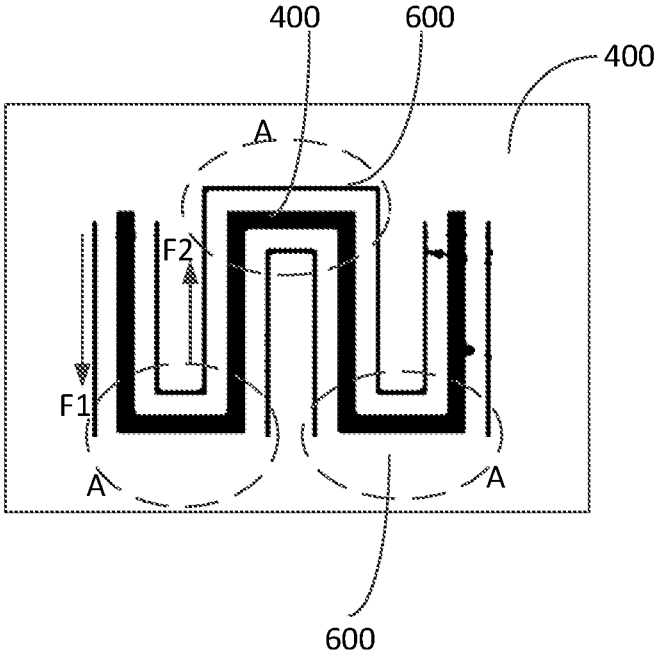
FIG. 5 is wiring direction diagram of first wires of a phase shifter provided in the present disclosure.
Figure 6:
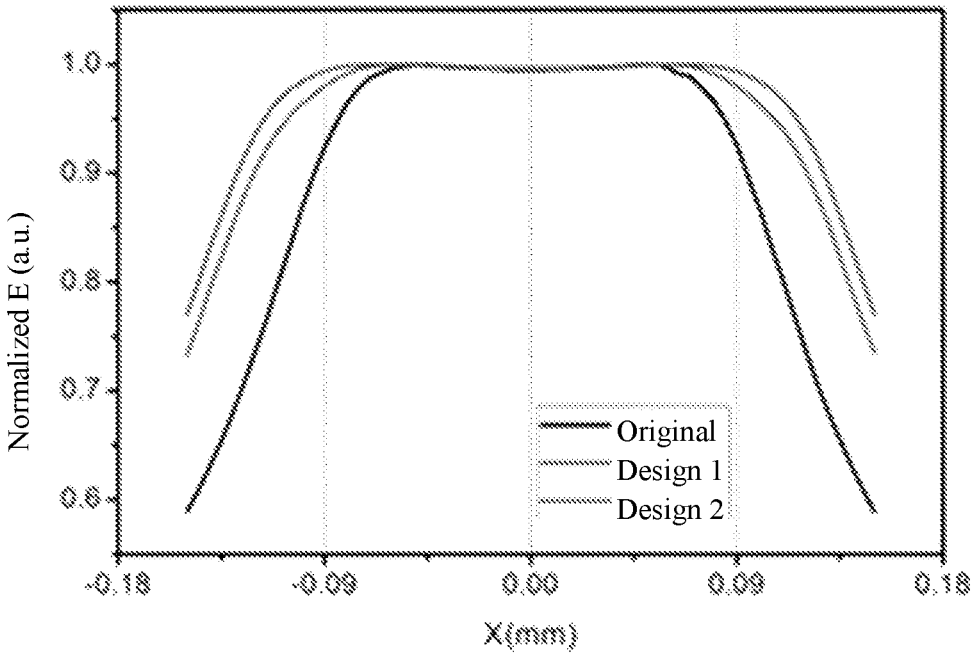
FIG. 6 is a diagram showing a comparison between an electric field regulation effect of a phase shifter in the related art and electric field regulation effects of phase shifters provided in Examples 1 and 2 of the present disclosure, wherein X-coordinate represents a coordinate in the horizontal direction with the midpoint of the transmission line in FIG. 1 being the origin of the coordinate, and the Y-coordinate denotes a modulus of electric field intensity; curve a illustrates an electric field intensity distribution of a phase shifter in the related art, curve b illustrates an electric field intensity distribution of a phase shifter in Example 1, and curve c illustrates an electric field intensity distribution of a phase shifter in Example 2.

Further, in one exemplary embodiment, as shown in FIG. 5, the transmission line 400 is wired in a serpentine pattern, and each of the first wires 600 is wired in a serpentine pattern following a same direction as the transmission line 400.

With the above arrangement, both the transmission line 400 and the first wires 600 adopt a manner of serpentine wiring. It should be noted that, the serpentine wiring follows a special curve and is a wiring mode whose main purpose is to adjust latency so as to meet a system timing design requirement. For example, as shown in FIG. 5, in one embodiment, one end of the wiring of the transmission line 400 extends a distance in a first direction F1, then bends back and extends a distance in a second direction F2 opposite the first direction F1, and bends back again and extends in the first direction F1. In this way, the transmission line 400 repeatedly bends back several times, so that a serpentine wiring structure is formed. In an exemplary embodiment, there are at least two bending portions A between two ends of the wiring of the transmission line 400. Correspondingly, the wiring of the first wire 600 bends back multiple times, to form a serpentine wiring structure, and there are at least two bending portions between two ends of the wiring of the first wire 600. Of course, it should be appreciated that, in practice, the transmission line 400 may run in other patterns.

Advantageous effects brought about by the present disclosure are as follows.

In the above-mentioned solution, a first wire is provided on two opposite sides of the transmission line of the phase shifter respectively, the first wires function to add additional electrostatic terminals on both sides of the transmission line, so that the electric field distribution between the transmission line and the phase control electrode is more uniform. Thus, the electric field distribution between the transmission line and the phase control electrode is regulated by adding the first wire on two sides of the transmission line respectively, and the electric field distribution in the medium layer with an adjustable dielectric constant between the transmission line and the phase control electrode can be closer to the ideal uniform distribution in a parallel plate capacitor. As a result, a variation range of effective dielectric constant of the medium layer with the adjustable dielectric constant that effectively influences the electromagnetic wave phase is enlarged, to achieve a goal of improving the phase shifting capacity of the phase shifter.

In addition, an embodiment of the present disclosure further provides an antenna including the phase shifter provided by the embodiment of the present disclosure:

Following points need to be explained.

(1) The drawings of the embodiments of the present disclosure relate only to the structures related to the embodiments of the present disclosure, and other structures can be designed with reference to common designs.

(2) For clarity, the thickness of layers or areas is exaggerated or reduced in the drawings used to describe the embodiments of the present disclosure, i.e., the drawings are not necessarily drawn to scale. It is understood that, when an element such as a layer, film, area or substrate is referred to as being "on" or "under" another element, it can be "directly on" or "under" the another element or intervening elements may be present.

(3) If no conflict is incurred, the embodiments of the present disclosure and features of the embodiments may be combined to obtain new embodiments.

The above description only describes specific implementations of this disclosure, but the scope of this disclosure is not limited thereto, and the scope of this disclosure is defined by the scope of the claims.

What is claimed is:

1. A phase shifter, comprising:

a first substrate and a second substrate arranged opposite to each other;

a medium layer located between the first substrate and the second substrate, wherein a dielectric constant of the medium layer is adjustable;

a phase shift unit, wherein the phase shift unit comprises a transmission line and a phase control electrode, the transmission line is arranged between the first substrate and the medium layer, and the phase control electrode is arranged between the second substrate and the medium layer; and a plurality of first wires, wherein the plurality of first wires are used for regulating an electric field between the transmission line and the phase control electrode, and an orthographic projection of the plurality of first wires onto the first substrate is parallel to an orthographic projection of the transmission line onto the first substrate, the orthographic projection of the plurality of first wires onto the first substrate is on both sides of the orthographic projection of the transmission line onto the first substrate, and the plurality of first wires are spaced from the transmission line by a first distance in a line width direction of the transmission line.

2. The phase shifter according to claim 1, wherein the medium layer is a liquid crystal layer, a lead zirconate titanate layer or a barium strontium titanate layer.

3. The phase shifter according to claim 1, wherein each of the plurality of first wires is a high-resistance wire with a resistance value 2 to 3 times a resistance value of the transmission line.

4. The phase shifter according to claim 3, wherein each of the plurality of first wires is made of indium tin oxide (ITO) or indium zinc oxide (IZO).

5. The phase shifter according to claim 4, wherein each of the plurality of first wires has a resistance value ranging from 70 ohms to 80 ohms.

6. The phase shifter according to claim 1, wherein each of the plurality of first wires has a line width ranging from 5 nm to 10 nm.

7. The phase shifter according to claim 1, wherein one of the plurality of first conductors is disposed on each of two opposite sides of the transmission line.

8. The phase shifter according to claim 1, wherein at least two of the plurality of first wires are disposed on each of two opposite sides of the transmission line, and adjacent two first wires of the at least two first wires are spaced from each other by a second distance.

9. The phase shifter according to claim 8, wherein three of the plurality of first conductors are disposed on each of two opposite sides of the transmission line.

10. The phase shifter according to claim 1, wherein the transmission line is wired in a serpentine pattern, and each of the plurality of first wires is wired in a serpentine pattern following a same direction as the transmission line.

11. An antenna, comprising the phase shifter according to claim 1.

* * * * *